United States Patent [19]

Wittersheim

[11] 4,309,119

[45] Jan. 5, 1982

[54] APPLICATOR DEVICE FOR COSMETIC PREPARATIONS

[75] Inventor: Adam Wittersheim, Mühltal, Fed. Rep. of Germany

[73] Assignee: Goldwell GmbH, Chemische Fabrik H.E. Dotter, Darmstadt-Eberstadt, Fed. Rep. of Germany

[21] Appl. No.: 160,821

[22] Filed: Jun. 18, 1980

[30] Foreign Application Priority Data

| | | | |
|---|---|---|---|
| Jul. 3, 1979 | [DE] | Fed. Rep. of Germany | 2926796 |
| Sep. 20, 1979 | [DE] | Fed. Rep. of Germany | 2937973 |
| Mar. 8, 1980 | [DE] | Fed. Rep. of Germany | 3008976 |

[51] Int. Cl.[3] ..... A46B 11/02; B43K 5/06; A45D 24/22

[52] U.S. Cl. ..... 401/188 R; 401/176; 401/273; 132/112

[58] Field of Search ..... 132/112, 113, 114, 115, 132/116, 80 R, 88.7, 85, 147; 401/188, 171, 176, 286, 4

[56] References Cited

U.S. PATENT DOCUMENTS

| | | | |
|---|---|---|---|
| 1,294,914 | 2/1919 | Kato | 401/4 |
| 1,937,006 | 11/1933 | Ar onson | 401/188 X |
| 2,382,314 | 8/1945 | Herb | 401/188 X |
| 3,429,642 | 2/1969 | Underwood | 132/116 X |
| 4,157,874 | 6/1979 | Durand | 401/4 |

*Primary Examiner*—Gene Mancene

*Assistant Examiner*—Mickey Yu

[57] ABSTRACT

Applicator device for cosmetic preparations, having a closed, substantially cylindrical casing in which a piston dividing the casing into two variable-size chambers sealed from one another is displaceably disposed, the one variable-size chamber being fillable with the cosmetic preparation and being combined with a removable applicator provided with a passage for the preparation, by means of which the cosmetic preparation can be applied to the body part being treated, in quantities controllable by means of a self-closing valve. The variable-size chamber opposite the preparation reservoir is provided with a connection for bringing in a compressed gas which seeks to displace the piston to reduce the preparation reservoir, and in the passage connecting the preparation reservoir chamber to the applicator there is disposed the self-closing valve preventing escape of the preparation when the applicator is removed. In the cylindrical casing there is a plunger extending into the preparation reservoir chamber and engaging directly or indirectly the valve body of the self-closing valve, which passes through the piston in a displaceable and sealed manner and is coupled in its end area remote from the self-closing valve with a venting valve for the variable-size compressed gas chamber lying opposite the preparation reservoir chamber such that the maximum opening movement transmitted by the valve body to the plunger upon the opening of the self-closing valve opens the venting valve.

21 Claims, 10 Drawing Figures

FIG. 9
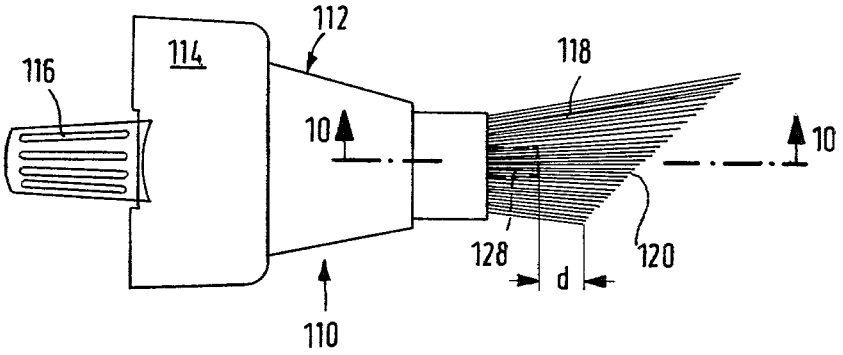
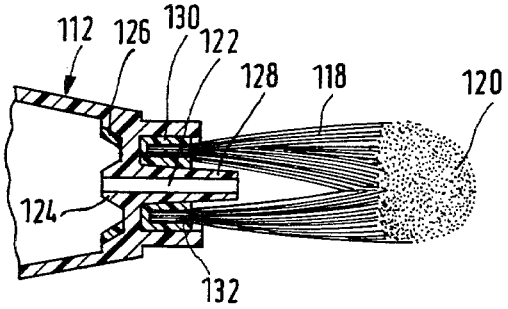
FIG. 10

APPLICATOR DEVICE FOR COSMETIC PREPARATIONS

BACKGROUND

The invention relates to an applicator device for cosmetic preparations, having a closed, substantially cylindrical casing in which there is displaceably disposed a piston dividing the casing into two variable-size chambers sealed from one another, the one variable-size chamber being fillable with the cosmetic preparation and being connected to a removable applicator provided with an outfeed passage for the preparation, by means of which the cosmetic preparation can be applied in measured amounts by means of a metering valve to the part of the body to be treated, the variable-size chamber opposite the preparation reservoir chamber being provided with a connection for the injection of a compressed gas which seeks to displace the piston to reduce the volume of the preparation reservoir, and in the passage joining the preparation reservoir chamber to the applicator there is disposed a self-closing valve preventing the escape of the preparation when the applicator is removed.

Devices for the application of liquid or creamy cosmetic preparations, such as shaving foam, shampoos, hair dressings and hair coloring preparations, in which the preparation to be applied is metered from a preparation reservoir chamber provided within the apparatus, to a suitable applicator whereby it can be applied to the part of the body or hair to be treated, are known in many embodiments (e.g., U.S. Pat. No. 3,032,803; U.S. Pat. No. 2,775,251; U.S. Pat. No. 2,603,223 and German OS No. 2,749,074). However, such devices have been unable hitherto to win acceptance for the application of hair coloring preparations because these preparations, which must be made by combining a dye paste and an oxidizing liquid immediately before use, i.e., they cannot be charged into a device and kept in storage, because otherwise the chemical reaction between the two components of the preparation, which is utilized for the hair dyeing, would be completed prematurely by the time they were put into use. Also, the chemical reaction causes these preparations to harden relatively fast and can result in tightly adherent coatings in the apparatus and to clogging. These characteristics of hair coloring preparations therefore necessitate the mixing and charging of the preparation into the device immediately prior to use and the careful cleaning of the device immediately after the treatment of the hair has been completed. In another known applicator device of the kind mentioned in the beginning (German Pat. No. 943,904), the pressure required for the dispensing of the preparation is produced by a small hand pump in the form of a resilient rubber bulb provided on the casing of the device, which is alternately squeezed and released by the hand grasping the casing. With the same hand, a button operating the self-closing valve must be pressed against the force of a spring during the application in order to meter the feed of the preparation to the applicator. This twofold operation tires the hand of the user and makes the manipulation of the device inconvenient and fatiguing. In hairdressers' shop practice, therefore, the procedure used in hair dyeing is conducted mainly by mixing the components of the preparation together in an open dyeing dish and then applying the preparation to the hair of the customer with a hand brush.

In contrast to this, the object of the invention is to improve the known applicator device so that it can be prepared simply and quickly for the hair treatment procedure, and so that after the treatment it can be cleaned out, while at the same time facilitating the manipulation of the device during the treatment.

Setting out from an applicator device of the kind mentioned in the beginning, this object is achieved in accordance with the invention by the fact that within the cylindrical casing there is provided a plunger which extends into the preparation reservoir chamber and directly or indirectly engaged the self-closing valve, passes sealingly and displaceably through the piston, and in its end portion remote from the self-closing valve is coupled to a venting valve for the variable-size compressed gas chamber opposite the preparation reservoir chamber such that the opening thrust transmitted by the valve to the plunger upon the opening of the self-closing valve opens the venting valve. In the applicator device thus constructed, when the applicator is removed, the device can be charged with the preparation through the self-closing valve without opening the casing. Advantageously, this charging is performed by means of a pressure can or a pump onto whose dispensing nipple the casing is pressed and thus simultaneously the self-closing valve is opened. This piston provided in the casing is displaced according to the size of the charge entering through the valve thus opened, in which case the compressed gas chamber opposite the preparation reservoir chamber must be vented, and this is accomplished by the automatic coupling of the self-closing valve through the plunger. After the preparation has been charged into the device, a compressed gas source is then connected to the compressed gas chamber, and by means of the overpressure then built up in this chamber, the preparation can be transferred from the preparation reservoir chamber into the applicator that has then been replaced on the casing, and from there onto the portion of the body of hair that is to be treated. The compressed gas can be compressed air, for example, which is delivered to the compressed gas chamber through a connecting line. Alternatively, the compressed gas source can also be a compressed gas cartridge that can be fastened to the compressed gas connection, or a small, refillable can containing an aerosol propellant, such as Frigen, for example. Both the compressed air and the aerosol propellant are available in modern cosmetic and hair dressing salons, now that the use of preparations foamed with compressed air, for example, is increasing in popularity. The operation by hand of a pump integrated into the device is therefore eliminated.

The device is at the same time preferably so contrived that the end of the plunger remote from the self-closing valve is brought sealingly and displaceably through the casing end wall which closes the compressed gas chamber and is provided with the compressed gas connection, and the plunger bears at its end outside of the casing the venting valve which extends into the venting aperture of the compressed gas chamber. Upon the depression of the self-closing valve for the purpose of filling the preparation reservoir with the preparation that is to be applied, therefore, the valve is positively drawn by the plunger out of the venting aperture of the compressed gas chamber, so that the compressed gas chamber is vented and the floating piston can shift without back pressure by an amount corresponding to the amount of preparation injected.

On the end of the plunger situated outside of the casing there is provided, in an advantageous further development of the invention, a container that can be filled with compressed gas, from which there projects a hollow nipple connected with its interior, which, when the plunger is engaged with the closed self-closing valve, engages the venting aperture of the compressed gas chamber and constitutes the venting valve.

It is desirable to provide in the venting aperture of the compressed gas chamber an annular packing which will form a seal on the circumference of the nipple of the compressed gas container when the venting valve is closed. The nipple can therefore enter with clearance into the venting orifice of the compressed gas chamber, so that an annular gap is formed between the nipple and the venting aperture as soon as the nipple is withdrawn from the annular packing.

The container that can be filled with compressed gas is then desirably also provided with a transfer valve that can be connected to a compressed gas source.

In an advantageous further development of the invention, the container which can be filled with compressed gas has on its front side facing the casing a cylindrical prolongation which, when the nipple of the container is in sealed engagement with the connection on the casing, rests against the rear wall of the casing; in the interior of this prolongation, the end of the plunger is held for longitudinal displacement such that the front end of the plunger and hence the piston through which this front end is passed, can be withdrawn, when the front casing wall is removed, through the then open front end of the casing. For the cleaning of the device thus constructed, all that need be done is remove from the casing the applicator and the closure of the front end of the casing, whereupon the piston that is displaceable on the plunger is pushed out of the open front end of the device by the compressed gas still present in the compressed gas chamber, and the mounting of the plunger on the compressed gas container, which is additionally displaceable longitudinally by the predetermined amount, permits the front end of the plunger and hence of the piston to be pushed out of the casing to such an extent that then the entire interior of the casing is accessible for rinsing out. The removed applicator and the front closure of the casing can then also be rinsed off without difficulty as can the piston which is then exposed in front of the casing.

The additional displaceability of the plunger by the necessary amount is achieved in a desirable development of the invention by the fact that, on the plunger end within the cylindrical prolongation there is mounted a crosspiece whose free ends engage in longitudinal recesses in the cylindrical prolongation, the length of these longitudinal recesses then determining the extent of the additional displaceability.

At the same time it is advantageous to give the crosspiece a slightly greater length than the outside diameter of the cylindrical prolongation, in which case the longitudinal recesses can then be elongated holes through the wall of the cylindrical prolongation. The outer ends of the crosspiece thus extend slightly behond the wall of the cylindrical prolongation and can be grasped by the hand, so that the control stem can then be intentionally pushed forward by the required amount if the residual gas cushion in the compressed gas chamber no longer suffices to push the piston together with the control stem all the way out of the opened casing.

The piston of the device is preferably provided with a pressure relief valve which will open to the compressed gas chamber when there is an excessive pressure in the preparation reservoir. This relief valve prevents any pressure harmful to the device from building up in the preparation reservoir. This might be conceivable, for example, in a case in which the device is filled with preparation up to its maximum capacity, i.e., the preparation reservoir is at its maximum volume and the piston is therefore at its end position, the plunger having been pullsed back to uncover the venting aperture. If now the plunger is pushed into the preparation reservoir for the purpose of closing the venting valve, the volume of the preparation reservoir will be reduced by that of the pushed-in plunger, so that the pressure will increase. If the piston then cannot yield, intolerable pressure might be produced. This danger is eliminated, however, by the relief valve.

In a preferred embodiment, the device is then so designed that the piston has on the side facing the compressed gas chamber a prolongation which is sealed against the plunger by an annular packing, through which the control stem passes, and in this prolongation there is provided at least one substantially radial through-bore which communicates the compressed gas chamber with the preparation reservoir through a gap existing between the plunger on the one hand and the bore and prolongation of the piston on the other, and that a resiliently expandable sealing ring is placed under bias over the orifice or orifices of the through-bore or bores. In order to secure the position of the sealing ring in line with the orifice of the through-bore, a circumferential annular recess can be provided in the area of the orifice or orifices of the through-bore or bores in the outer peripheral wall of the prolongation, in which the sealing ring will be held secure against axial displacement. A commercially available O-ring of rubber-elastic material is best used as the sealing ring.

The annular gasket sealing the preparation reservoir chamber against the penetration of preparation into the compressed gas chamber is best an annular lipped packing disposed on the prolongation, whose annular lip sealingly engages the control stem. An especially simple design is achieved if the piston, the prolongation and the lipped packing are made of one piece of plastic.

If the applicator device of the invention is to serve for the application of a hair dye preparation to be prepared from two components to be mixed together immediately before the treatment, it is recommendable to dispose on the plunger end in the preparation reservoir adjacent the self-closing valve a mixing means for the intimate mixing of preparation components charged into the preparation reservoir. The preparation components can then be placed in the reservoir separately in the required amount through the self-closing valve, and can be prepared by the mixing means to form the ready-to-use dye preparation.

To be able to store a sufficient volume of compressed gas even when the device is largely filled with preparation, it is recommendable to provide in the end wall closing the compressed gas chamber a space of lesser diameter than the diameter of the cylindrical casing, whose volume is at least equal to the volume of the section of the plunger that is within the preparation reservoir when the plunger is all the way in and the piston is all the way out. In addition to serving for the storage of compressed gas, this additional chamber will also serve to accommodate any preparation that might overflow from the preparation reservoir through the relief valve.

The applicator of the applicator device is provided with a pusher which comes into contact with the self-closing valve when the applicator is fastened to the cylindrical casing, and which serves for the opening of the self-closing valve when the applicator device is in use. The pusher is best affixed to the applicator and the applicator is to be able to be fastened to the cylindrical casing in a position in which the pusher still does not open the self-closing valve, the fastening arrangement on the housing being so designed that the applicator is displaceable additionally by a certain amount in the direction of the preparation reservoir, which will suffice to open the self-closing valve. The feeding of the preparation will then be controlled entirely by displacing the applicator, and a handle facilitating this displacement can be provided on the applicator. In certain cases, the opening of the self-closing valve can also be produced simply by pressing the applicator against the part of the body or hair that is to be treated. It is clear that the actuating stroke transferred by the pusher to the self-closing valve when the applicator is operated must be shorter than when the preparation reservoir is charged with the components, in order to assure that the venting aperture of the compressed gas chamber will remain closed. By a corresponding limitation of the stroke of the applicator, however, this can quite easily be assured.

In the area of the emergence of the preparation from the applicator it is desirable to provide a brush with which the preparation can be brushed into the hair beginning from the hair roots.

In this case the design is preferably made such that the orifice of the discharge passage of the applicator is within the brush, and that the brush application surface formed by the free ends of the bristles of the brush lies in a plane which is at an angle of between 30° to 60° to the longitudinal center axis of the passage. This slope of the contact surface has the purpose not only of permitting a more comfortable position of the brushing surface when working with the device, because this could also be accomplished by similarly angled arrangement of a brush having a brushing surface at right angles to the passage, but in this manner it is brought about that the orifice of the passage can be disposed at a relatively short distance from the middle of the brushing surface and nevertheless a portion of the bristles will still project sufficiently for resilience and softness. In other words, the distance traveled by the preparation to the brushing surface is on the one hand so short that the preparation will emerge in the necessary manner at the brushing surface instead of, say, emerging laterally out of the brush. The preparation can then be distributed from the area of its emergence over the entire brushing surface as operation progresses, i.e., also into the area of the longer, softer bristles with which the strands of hair are then coated. By holding the applicator device with the applicator in the appropriate position, the hair strands can also be treated selectively with the stiffer, shorter or softer, longer bristles, which is not possible with a brush of bristles of all the same length, because such bristles would all have approximately the same stiffness.

In a preferred further development, the passage is provided in a tubular projection disposed centrally within the bristles surrounding it, and projecting from the applicator body, and its forward end as seen in the direction of the emergence of the preparation terminates ahead of the point of the brushing surface nearest the casing. In other words, there is no danger that the tubular projection will be placed directly on a strand of hair much less on the scalp of the person being treated.

The invention will be further explained in the following description of three embodiments in conjunction with the drawing, wherein:

FIG. 9 is a side elevational view of an advantageous applicator brush designed for the applicator device of the invention, and FIG. 10 is a side elevational view through the front portion of the applicator as seen in the direction of the arrows 10—10 in FIG. 9.

Figure 1:
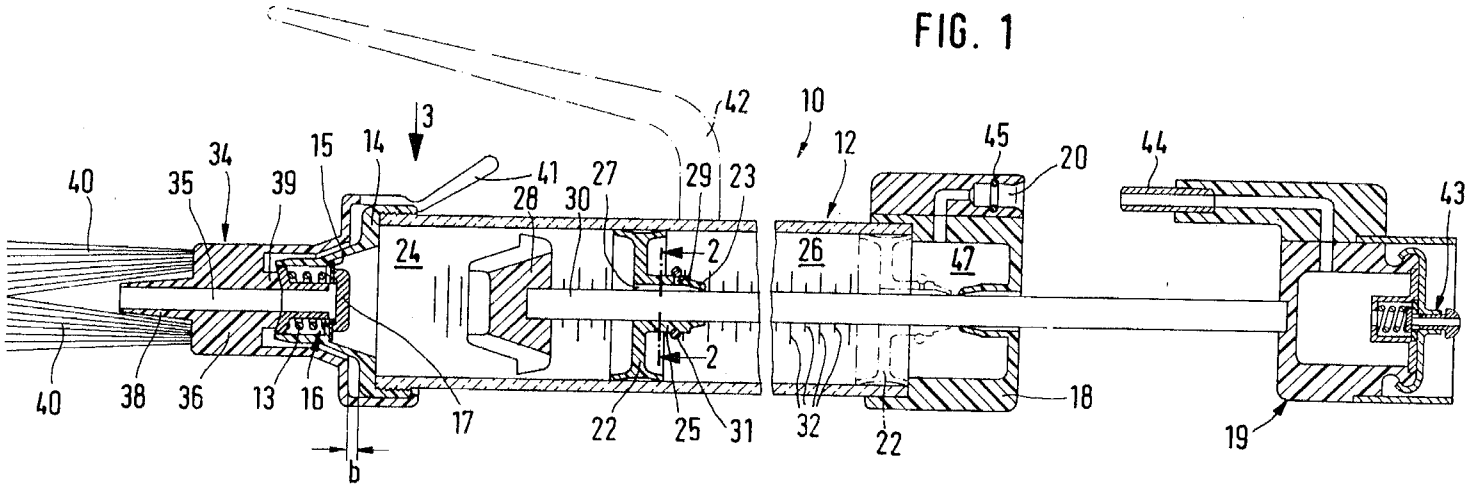
FIG. 1 represents a longitudinal cross section through the center of a first embodiment of an applicator device intended for the mixing and application of a hair dyeing preparation and constructed in the manner of the invention.
Figure 2:
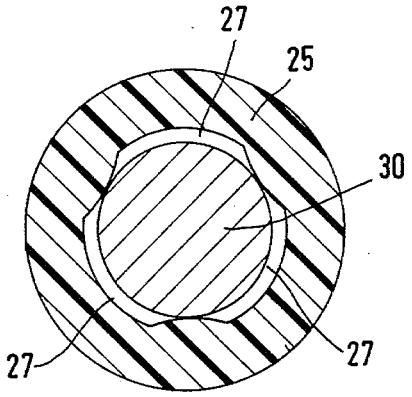
FIG. 2 is a cross-sectional view on a larger scale as seen in the direction of the arrows 2—2 in FIG. 1.
Figure 3:
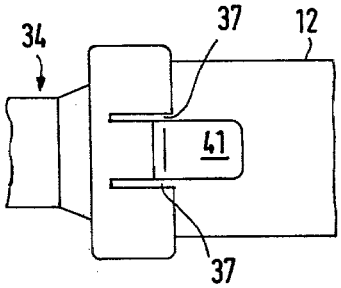
FIG. 3 is a partial view of the applicator device as seen in the direction of the arrow 3 in FIG. 1.

The applicator device 10 of the invention, shown in FIGS. 1 to 3, has a handle portion in the form of a cylindrical casing 12 having an end cap 14 threaded onto it, in the center of which there is provided a self-closing filler valve 17 biased by a spring 13 against a valve seat 15, such that, when the preparation is injected into the casing 12 through the filler connection, the valve will be lifted from its seat, thus permitting the preparation to enter into the interior of the casing.

In the rear end cap 18 of the casing 12 there is provided a compressed gas charging and venting connection 20, to which can be connected a compressed gas source 19, such as for example an aerosol propellant can which can be refilled from a supply tank.

The interior of the casing 12 is divided into two chambers sealed from one another by a freely displaceable, i.e., floating, piston 22; the chamber 24 on the valve side serves as a reservoir for the preparation to be applied, while the chamber 26 between the back of the piston and the rear end cap 18 can be filled through the connection 20 from the source 19 of compressed gas or propellant gas which seeks to displace the piston 22 toward the front end cap 14. The valve 16 provided in cap 14 prevents this, however, as long as it remains closed. Between the front end cap 14 and the piston 22 a mixing member 28 in the form of a body provided with a plurality of mixing vanes is disposed in the chamber 24, being fastened to the inner end of a plunger 30 brought sealingly and displaceably through the piston 22 and the casing end cap 18. When the piston 22 has been shifted by the filling of chamber 24 with preparation through the valve 16 with reduction of the volume of chamber 26 to a position represented in broken lines in FIG. 1, the preparation contained in chamber 24 can be mixed by moving the plunger 30 back and forth, and with it the mixing member 28. Such a mixing action is required whenever the preparation to be applied consists of two or more components injected separately into the preparation reservoir.

The compressed gas source is uncoupled while the casing 12 is being loaded, so that no back-pressure will be produced in chamber 26. The piston 22 therefore shifts when the reservoir 24 is being filled, by an amount corresponding to the quantity of preparation or of individual preparation components put in, so that its position, therefore, is a measure of the amount of preparation contained in the chamber 24. A graduation 32 applied to the casing 12, which is made preferably of a transparent plastic, permits determining the amount of preparation contained in the casing, which can be gauged according to the position of the piston surface on the valve side.

The piston 22 has on its side facing the chamber 26 a prolongation 25 through which the plunger 30 passes sealingly by means of the lipped annular packing 23 integral with the prolongation. Between the bore in the prolongation and in the piston, gaps 27 (see also FIG. 2) are provided, which communicate with the chamber 24; these gaps would create a connection with chamber 26 through radial bores 29 in the prolongation, were it not for the fact that a resiliently expansible O-ring 31 placed with bias over the orifices of the bores 29 close these bores off. Normally, therefore, the passage of preparation from chamber 24 to chamber 26 is prevented. If, however, the pressure in chamber 24 exceeds a value given by the bias of ring 31, the ring expands and allows preparation to pass through. Vice versa, the passage of compressed gas from chamber 26 into chamber 24 is prevented, because the compressed gas pressure prevailing in chamber 26 merely additionally urges ring 31 against the orifices of the bores 29. The radial bores 29 and the ring 31 therefore constitute an overpressure valve of very simple and economical design.

On the end cap 14 of casing 12 an applicator 34 consisting of a cup-like plastic body 36 is mounted by snapping its edge over the back edge of end cap 14; it has a through-bore 35 on its central axis, whose outer end terminates in a tubular prolongation 38 of reduced outside diameter, which is surrounded by tufts 40 of bristles fastened in the plastic body 36. At the end of through-bore 35 adjacent the self-closing valve 16, the bore terminates in a projecting pusher 39 which, when properly installed, engages the outer end of a stem of the valve 17 without lifting valve 17 from its seat 15. If the applicator 34, however, is additionally drawn slightly away from the position shown in FIG. 1 towards the casing 12, the pusher 39 will open the valve 17, while the spring 13, which is thus additionally compressed, will seek to force the applicator 34 back again. The locking of the cup-like portion of the plastic body 36 to the end cap 14 is made possible by the fact that the cup margin, which is constricted, is made resiliently expansible by two slits 37 (FIG. 3). The portion of the cup situated between the slits is made integral with a paddle-like lever 41 extending angularly away from the casing 12, which on the one hand facilitates the attachment and removal of the applicator from the casing 12 and on the other hand also serves as an operating lever for the controlled opening of valve 16. For this purpose the person operating the device can pull the lever back with a finger or thumb and swing it back against the casing, and a hook engaging the back edge of the front cap 14 will displace the applicator 34 in the valve-opening direction.

The operation of the applicator device is further improved if a prong 42 is provided on the casing for the separation and lifting of individual strands of hair for treatment, as is indicated in broken lines in FIG. 1.

Figure 5:
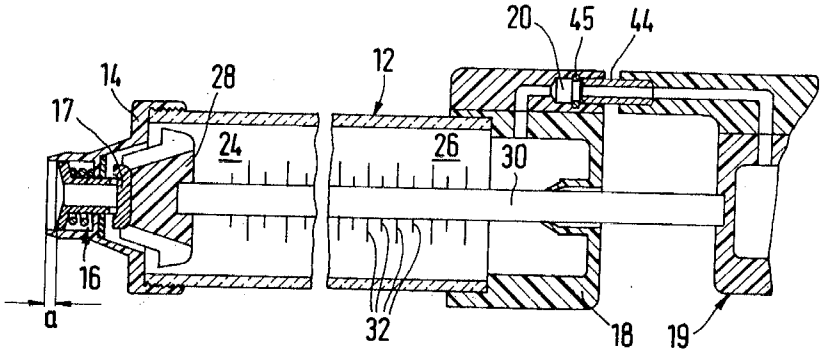
FIG. 5 shows the applicator device with the applicator removed, with its parts in the position which they assume when the preparation is being charged into it.
Figure 4:
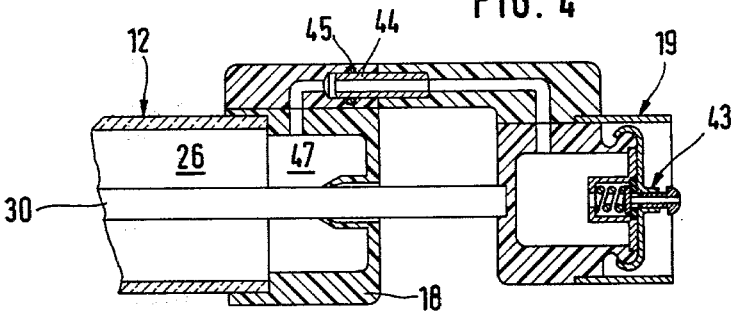
FIG. 4 is a cross-sectional view taken in the same manner as in FIG. 1 through the rear portion of the applicator device.

The compressed gas source 19, in the form of an aerosol container which can be filled through a transfer valve 43, is fastened on the outer end of the plunger 30 as shown in FIGS. 1, 4 and 5. A transfer tube extending laterally from the container 19 projects towards the casing 12 and terminates in a nipple 44 which can be inserted into the connection 20 connecting it to the compressed gas chamber 26. An annular packing 45 in the form of an O-ring inserted into connection 20 seals the circumference of the nipple 44 when the latter is inserted all the way into the connection 20 (FIG. 4), so that then the Frigen charged in liquid form into container 19 can flow into the compressed gas chamber where it evaporates so that a pressure corresponding to its evaporation pressure is built up, acts on the piston 22 and thereby on the preparation contained in the preparation reservoir, and, when the self-closing valve opens, drives it into the applicator 34.

If, however, the nipple 44 is withdrawn from orifice 20 only slightly away from the fully inserted position (FIG. 4) in the manner illustrated in FIG. 5, the O-ring 45 will no longer engage the circumference of the connection, and compressed gas contained in the compressed gas chamber 26 and/or in container 19 will escape, allowing the pressure to drop to the ambient pressure.

When preparation components are charged into the preparation reservoir 24 through the self-closing charging valve 16, there must be no back-pressure in the compressed gas chamber 26, i.e., the compressed gas chamber must be vented, i.e., uncoupled from the container 19. This is accomplished automatically, as shown in FIG. 5, when the valve 17 is lifted by the amount a from its seat, since this movement a is transmitted through the mixing member 28, the plunger 30 and the container 19 to the nipple 44. The nipple 44 therefore acts as a valve for venting the compressed gas chamber 26 automatically when preparation components are charged into the preparation reservoir 24. On the other hand, of course, care must be taken to provide that the automatic venting described above will be unable to take place while the applicator device is in use. This is assured in the present embodiment by limiting the movement b (FIG. 1) exercised with the applicator 34 on the charging valve 17 to an amount that is less than the movement a.

When the components charged into the preparation reservoir 24 are to be mixed together in the manner described before, by the reciprocating movement of the plunger 30 and hence of the mixing body 24 within the reservoir, this must be possible without interference from the nipple 44, by turning the entire container 19, after the withdrawal of the nipple 44 from the gas admission and exhaust orifice 20, thereby setting the connection out of alignment with the orifice 20, and making it possible for the plunger to be pushed forward without interference until the mixing member 28 engages the valve 17. The container 19, which is the compressed gas source, then serves as a handle for the operation of the plunger.

Figure 6:
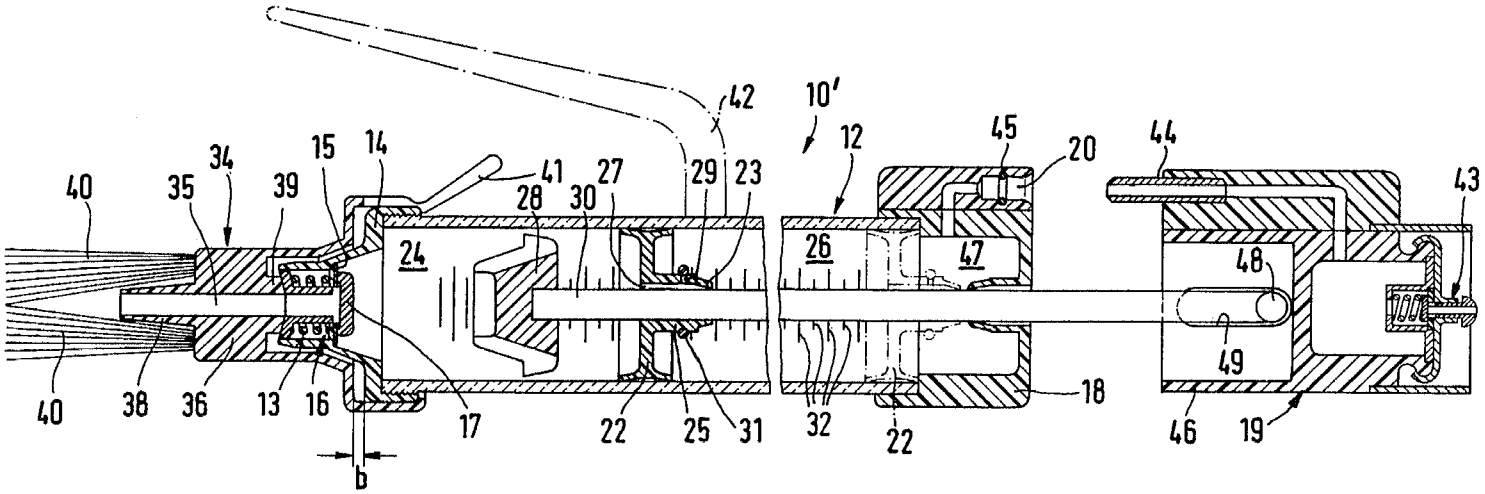
FIG. 6 is a longitudinal central cross section through a second embodiment of an applicator device of the invention which is intended for the mixing and the application of a hair dyeing preparation.
Figure 7:
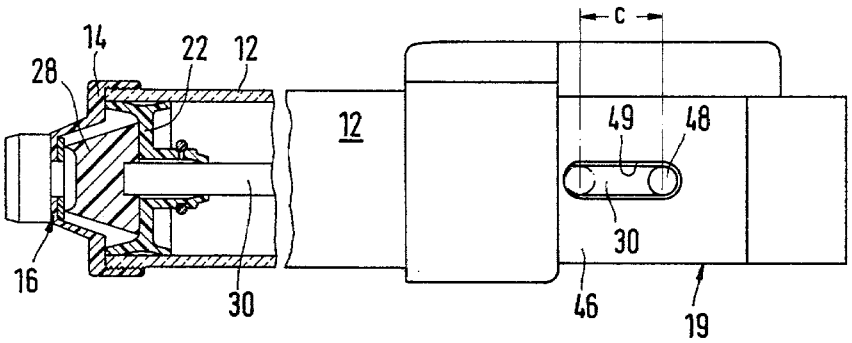
FIG. 7 shows the applicator device of FIG. 6, with the applicator removed, with its working parts in the position they assume prior to filling with the preparation, only the front portion of the device being represented in cross section.
Figure 8:
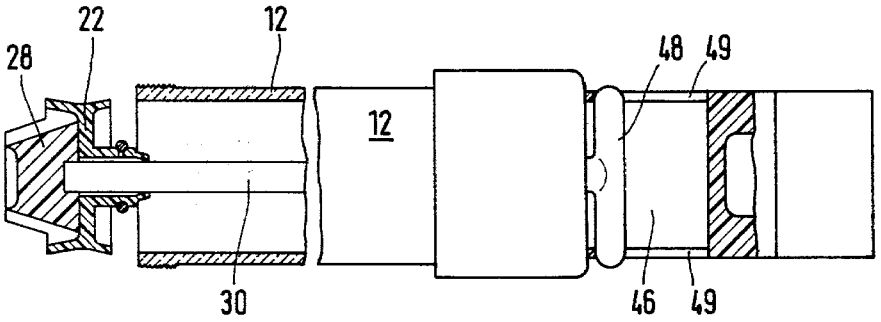
FIG. 8 shows the applicator device with the applicator and front casing end wall removed, in a position rotated 90° about its longitudinal central axis, with its working parts in a position in which the interior of the device is accessible for cleaning.

The embodiment of an applicator device 10' which is shown in FIGS. 6 to 8 has essentially the same construction as the applicator device 10 described above. Since the same parts of the two devices are provided in the drawing with the same reference symbols, it will suffice to consult the above description with regard to that which is the same, whereas from henceforth only the modifications and improvements will be explained, which relate essentially to the manner of attaching the plunger 30 to the aerosol container 19 serving as the compressed gas source. From the bottom of the container 19 there extends a cylindrical prolongation 46 which rests against the casing end cap 18 when the nipple 44 is pushed all the way into the connection 20, i.e., when compressed gas can pass from the compressed gas source 19 into the compressed gas chamber 26. A cross-piece 48 is provided on the end of plunger 30 which extends into the interior of the cylindrical prolongation 46, and its two free ends engage in elongated holes 49 disposed parallel to the plunger in the cylindrical prolongation 46, thereby permitting the plunger 30 to be displaced by the amount c (FIG. 7) relative to the cylindrical prolongation 46 and hence to the compressed gas source 19. In FIG. 7 it can be seen that the length of the plunger 30 is such that, when the compressed gas source 19 is in the position in which it is coupled sealingly to the casing 12, the crosspiece 48 of the plunger 30 is at the end of elongated hole 49 that is remote from the casing, while the mixing member provided at the end of plunger 30 that is within the casing just barely engages the self-closing valve. This assures on the one hand that, when the self-closing valve 16 is operated—e.g., by the introduction of the filler connection of a preparation container for the purpose of charging the preparation reservoir 24—the operating movement exercised on the valve 17 will be transmitted through the plunger 30 to the compressed gas source 19, while the nipple 44 of the compressed gas source will be withdrawn out of connection 20 of the casing to the extent that the compressed gas chamber 26 will be vented to the ambient atmosphere, i.e., when the preparation reservoir 24 is filled, the compressed gas chamber 26 is automatically vented.

On the other hand, when the front end cap 14 is removed from the casing, the plunger 30 can be displaced by the amount c until the ends of the crosspiece 48 contact the ends of the elongated holes 49 adjacent the casing, so that then the mixing member 28 and the piston 22, pushed into contact with the mixing member 28 by the pressure prevailing in the compressed gas chamber 26, emerge from the casing 12 and are thus accessible for a simple rinsing procedure, in which case they simultaneously expose the interior of the casing so that it can be rinsed free of any adhering residues of the preparation, as clearly shown in FIG. 8.

After cleaning, the piston 22 and the mixing member 28 are drawn back into the casing interior by drawing back the plunger 30, and the end cap 14, which has also been cleaned, is placed back onto the casing 12. The applicator device 10 is then ready for another use.

The additional limited longitudinal movement c of the plunger, which is made possible by the displaceable mounting of the plunger in the compressed gas source, therefore permits a complete cleaning of the applicator device without the necessity of taking it entirely apart.

In FIGS. 9 and 10 there is represented an applicator generally designated by the numeral 110, which is improved with respect to applicator 34. Applicator 110 consists of an applicator body 112 having at its one end (left in FIG. 9) a cup-like portion 114 by which the applicator can be installed on the applicator device 10 or 10'. One lever-like projection 116 is made integral by injection molding with the cup-like portion 114 on each of two opposite sides thereof, these projections serving for the operation of the self-closing valve of the applicator device.

At the end remote from the cup-like portion 114 (i.e., at the right end in FIG. 9), a pencil brush 118 is disposed on the applicator 110, and serves for the application and brushing of the preparation fed to it from the applicator device onto the parts of the body to be treated, such as a strand of hair, for example. The brushing surface 120 formed by the free ends of the bristles of brush 118, unlike the ends of the bristles of the brush of the previously described applicator 34, are in a plane disposed at an angle of approximately 45° to the longitudinal central axis of the applicator, as best seen in the side view given in FIG. 9.

The feeding of the preparation to the brush 118 is accomplished through a passage 122 provided centrally in the longitudinal center axis of the body 112, which terminates at its inside in a truncoconical nipple 124 which can engage complementary truncoconical recess in the end of the applicator device 10 and 10'. An annular packing 126 of resiliently compressible material assures that the preparation emerging from the applicator device can enter only into the passage 122, but not into the interior of the cuplike part 114.

The passage 122 running along the longitudinal central axis of the body 112 terminates at its end remote from the applicator device in a tubular projection 128 extending from the body 112 centrally within the surrounding bristles of the brush 118, the length of the tubular projection 128 being such that its orifice through which the preparation emerges terminates at a point at a distance d from the point of the brush application surface 120 nearest the casing. The bristles of brush 118 are set in an annular brush body 130 which is inserted into an annular recess in the applicator body 112 concentrically surrounding the tubular projection 128, and there it is fastened by cementing or by a snap-in connection.

The body 112 of applicator 110 is made of plastic by the injection molding process, as is the brush body 130.

I claim:

1. Applicator device for cosmetic preparations, having a closed, substantially cylindrical casing, a piston dividing said casing into two variable-size chambers sealed from one another, being displaceably disposed in said casing, one of said variable-size chambers forming a reservoir chamber fillable with a cosmetic preparation and being combined with a removable applicator provided with a passage for the preparation, by means of which applicator the cosmetic preparation can be applied to a body part to be treated in quantities controllable by means of a self-closing valve, the other of said variable-size chambers being located opposite said preparation reservoir chamber and being provided with a connection for admitting compressed gas for displacing the piston to reduce the size of the preparation reservoir chamber, said self-closing valve being disposed in said passage for preventing escape of the preparation when the applicator is removed and having a body, a plunger in said casing extending into said preparation reservoir chamber and engaging directly or indirectly said valve body of said self-closing valve, said plunger passing through said piston in a displaceable and sealed manner and being coupled in its end area remote from said self-closing valve with a venting valve for said other variable-size chamber such that maximum opening movement transmitted by said valve body to said plunger upon opening of said self-closing valve opens said venting valve.

2. An applicator device according to claim 1, wherein said plunger extends sealingly and displaceably through a casing end wall closing said compressed gas chamber provided with said compressed gas connection, and has an end situated outside of said casing and remote from said self-closing valve, which end has attached thereto a valve body of said venting valve engaging a venting orifice of said compressed gas chamber.

3. An applicator device according to claim 2, wherein said end of said plunger situated outside said casing includes a container fillable with compressed gas, from which said valve body in the form of a hollow nipple projects, which engages sealingly said venting orifice of said compressed gas chamber when said plunger engages said self-closing valve when closed.

4. An applicator device according to claim 3, wherein an annular packing is disposed in said venting orifice of said compressed gas chamber which, when said venting valve is closed, sealingly engages the circumference of said nipple of said compressed gas container.

5. An applicator device according to claim 3 wherein said container fillable with compressed gas is provided with a transfer valve adapted to be connected to a compressed gas source.

6. An applicator device according to claim 3 wherein said container fillable with compressed gas has on its front end facing said casing a cylindrical extension which rests against the casing end wall remote from said self-closing valve when said nipple is sealingly engaged in said connection on said casing, and in whose interior said end of the plunger is mounted for longitudinal displacement by such an amount that the front end of the plunger adjacent said self-closing valve and therefore said piston mounted on said front end can be pushed out of the front end of said casing which is open when said front casing end wall is removed.

7. An applicator device according to claim 6, wherein on said end of said plunger lying within said cylindrical extension a crosspiece is provided having free ends engaging in longitudinal recesses in said cylindrical extension.

8. An applicator device according to claim 7, wherein said crosspiece has a slightly greater length than the outside diameter of said cylindrical extension, and wherein the longitudinal recesses are elongated holes through the wall of said cylindrical extension, parallel to said plunger.

9. An applicator device according to claim 1, wherein said piston is provided with a relief valve opening to the compressed gas chamber in the event of excessive pressure in the preparation reservoir chamber.

10. An applicator device according to claim 9, wherein said piston has on the side facing the compressed gas chamber a prolongation through which the plunger passes and which is sealed against the plunger by an annular packing, at least one substantially radial through-bore being provided in its portion within the compressed gas chamber, which communicates through a gap existing between the plunger and a bore in the piston with the preparation reservoir chamber, and a resiliently expansible annular packing placed under bias over said at least one through-bore.

11. An applicator device according to claim 10, wherein a circumferential annular recess is provided in the area of said at least one through-bore in the outer circumferential wall of said prolongation, in which said annular packing is held.

12. An applicator device according to claim 10, wherein said annular packing is a circular loop or O-ring of rubber-elastic material.

13. An applicator device according to claim 10, wherein an annular lipped padding seals the preparation reservoir chamber against an entry of the preparation into the compressed gas chamber, said packing being disposed on the prolongation and having an annular lip sealingly engaging said plunger.

14. An applicator device according to claim 13, wherein said piston, said prolongation and said lipped packing are injection molded integrally of plastic.

15. An applicator device according to any one of claims 1 to 14, wherein on the end of the plunger adjacent said self-closing valve there is provided a mixing member for the intimate mixing of preparation components charged into the preparation reservoir chamber.

16. An applicator device according to any one of claims 1 to 14, wherein in the end wall closing the compressed gas chamber a chamber of lesser diameter than the diameter of the cylindrical casing is formed, whose volume is at least equal to the volume of the section of said plunger lying in the preparation reservoir when said plunger is pushed all the way in to the casing and the piston is withdrawn therefrom to the maximum.

17. An applicator device according to any one of claims 1 to 14, wherein the applicator has a pusher which engages said self-closing valve when it is fastened to said cylindrical casing.

18. An applicator device according to claim 17, wherein said pusher is fixedly joined to the applicator and the applicator is adapted to be fastened to the cylindrical casing in a position wherein the pusher does not yet open the self-closing valve, and a fastening arrangement on the casing being devised such that the applicator is displaceable in the direction of the preparation reservoir chamber by a certain additional amount which opens the self-closing valve but is smaller than the opening movement required for the opening of the venting valve.

19. An applicator device according to any one of claims 1 to 14, wherein a brush is disposed on the applicator in the area of the emergence of the preparation from the applicator.

20. An applicator device according to claim 19, wherein an aperture of a conduit of the applicator is disposed within the brush, and wherein the brushing surface formed by the freely projecting ends of the bristles of the brush lies in a plane inclined at an angle of about between 30° to 60° to the longitudinal central axis of said conduit.

21. An applicator device according to claim 20, wherein said conduit is provided in a tubular prolongation projecting from a casing of said applicator centrally within the bristles surrounding it, the front end thereof, as seen in the direction of emergence of the preparation terminating ahead of the point of the brush application surface nearest the casing.

* * * * *